US008089413B2

(12) United States Patent
Minemura et al.

(10) Patent No.: US 8,089,413 B2
(45) Date of Patent: Jan. 3, 2012

(54) RADIO APPARATUS AND ANTENNA ADAPTED FOR CONTACTLESS COMMUNICATION

(75) Inventors: Takashi Minemura, Tokyo (JP); Naoto Ito, Tokyo (JP)

(73) Assignee: Kabushiki Kaisha TOSHIBA, Tokyo (JP)

( * ) Notice: Subject to any disclaimer, the term of this patent is extended or adjusted under 35 U.S.C. 154(b) by 477 days.

(21) Appl. No.: 12/402,647

(22) Filed: Mar. 12, 2009

(65) Prior Publication Data

US 2010/0052999 A1 Mar. 4, 2010

(30) Foreign Application Priority Data

Aug. 29, 2008 (JP) ..... 2008-222699

(51) Int. Cl.
*H01Q 1/24* (2006.01)

(52) U.S. Cl. ..... 343/702; 343/742; 343/867
(58) Field of Classification Search ..... 343/702, 343/741, 866, 867
See application file for complete search history.

(56) References Cited

U.S. PATENT DOCUMENTS

2005/0040997 A1* 2/2005 Akiho et al. ..... 343/866
2006/0114159 A1* 6/2006 Yoshikawa et al. ..... 343/702
2008/0252551 A1* 10/2008 Kubo et al. ..... 343/867

FOREIGN PATENT DOCUMENTS

JP 2005-026865 A 1/2005
JP 2005-134942 A 5/2005

* cited by examiner

*Primary Examiner* — Hoanganh Le
(74) *Attorney, Agent, or Firm* — Holtz, Holtz, Goodman & Chick, PC

(57) ABSTRACT

A radio apparatus having a casing and an antenna is provided. The casing has first, second and third faces. The second face and the third face correspond to a side face and another side face of the first face, respectively. The antenna is formed by a conductive line in such a way that the conductive line forms a first loop shape, a second loop shape and a third loop shape, that the first loop shape includes a first portion and a second portion positioned adjacent to a third portion of the second loop shape and a fourth portion of the third loop shape, respectively, that directions of currents distributed on the first portion and the third portion if the antenna is fed are almost same, and that directions of currents distributed on the second portion and the fourth portion if the antenna is fed are almost same.

12 Claims, 4 Drawing Sheets

RADIO APPARATUS AND ANTENNA ADAPTED FOR CONTACTLESS COMMUNICATION

CROSS-REFERENCE TO RELATED APPLICATIONS

This application is based upon and claims the benefit of priority from the prior Japanese Patent Application No. 2008-222699 filed on Aug. 29, 2008; the entire contents of which are incorporated herein by reference.

BACKGROUND OF THE INVENTION (i) Field of the Invention

The present invention relates to a radio apparatus and an antenna, and in particular to a radio apparatus configured to face an external apparatus so as to perform contactless communication with the external apparatus, and to an antenna provided in the radio apparatus.

(ii) Description of the Related Art

Radio frequency identification (which will be abbreviated to RFID hereinafter) technology has been widely used for automatic ticket gates of railroads, working hour management of companies or offices, various kinds of electronic money and so on. In an RFID system, information is exchanged through radio transmission and reception between a device called a reader/writer and a data medium called a card or a tag (which is called contactless data communication). Recently, mobile phones of some types are equipped with RFID, starting from a card function and then covering a reader/writer function.

In the RFID system, an antenna included in the reader/writer and an antenna included in the card are arranged opposite and close to each other so as to communicate with each other, so that the reader/writer may write data to the card and read data from the card. A planer loop-shaped coil-like element is usually used as the antenna of the RFID system.

In a mobile phone naming the card function, e.g., a loop-shaped antenna of the RFID system is usually arranged close to either one of a front side or a back side of a casing of the mobile phone. In this case, due to a thickness of the casing, the antenna exhibits a magnetic field distribution characteristic deflected towards the side to which the antenna is arranged close. Thus, success or failure, or an error rate, in the contactless data communication is limited by an orientation of the casing to the reader/writer as well as by a separation between the casing and the reader/writer.

Related art to address such a problem is known as disclosed in, e.g., Japanese Patent Publication of Unexamined Applications (Kokai), No. 2005-26865 or No. 2005-134942. JP 2005-26865 discloses a data communication apparatus having an antenna arranged around and alone sides of a casing. JP 2005-134942 discloses a reader/writer having an antenna unit formed by a printed board contained in a main body and having multiple antennas having antenna axes in multiple directions.

The apparatus of JP 2005-26865 is configured to correct the deflection of the magnetic field distribution by positioning the antenna near a center in a thickness direction of the casing. Such a configuration, however, has a limited effect in a case of lots of mobile phones, e.g., where pivotally connected two casings are being closed to each other.

The antenna unit of the reader/writer of JP 2005-134942 has the antenna axes in a direction of a side of the main body by means of a thickness of the printed board or a layered structure of multiple printed boards. As having an effect depending on the thickness and/or the number of the printed boards, however, the antenna unit of JP 2005-134942 has difficulty in exhibiting the effect in a case where the casing is made thin.

SUMMARY OF THE INVENTION

Accordingly, an advantage of the present invention is to reduce deflection of magnetic field distribution that occurs if power is fed to an antenna regardless of a configuration and/or a size of a casing of a radio apparatus, so as to expand space in which contactless communication is available.

To achieve the above advantage, one aspect of the invention is to provide a radio apparatus having a casing and an antenna. The casing has a first face, second face and a third face. The second face and the third face correspond to a side face and another side face of the first face, respectively. The antenna is formed by a conductive line in such a way that the conductive line forms a first loop shape, a second loop shape and a third loop shape, that the first loop shape includes a first portion and a second portion positioned adjacent to a third portion of the second loop shape and a fourth portion of the third loop shape, respectively, that directions of currents distributed on the first portion and the third portion if the antenna is fed are almost same, and that directions of currents distributed on the second portion and the fourth portion if the antenna is fed are almost same.

DETAILED DESCRIPTION OF THE INVENTION

Figure 1:
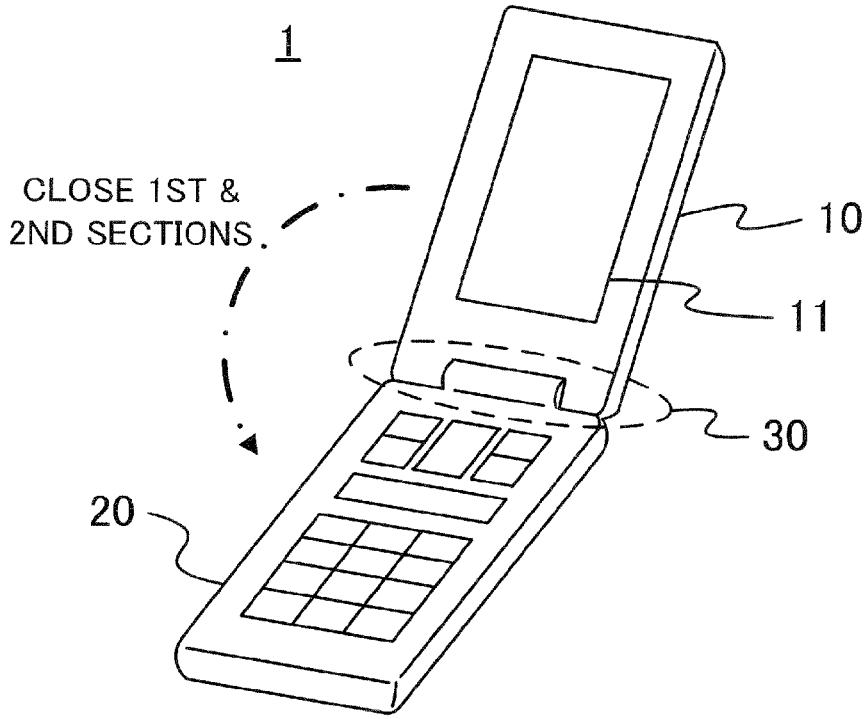
FIG. 1 is a perspective view showing a configuration of a radio apparatus (a mobile communication terminal) of an embodiment of the invention.

Hereinafter, an embodiment of the present invention will be described with reference to FIGS. 1-7. In following descriptions, terms such as upper, lower, left, right, horizontal or vertical used while referring to a drawing shall be interpreted on a page of the drawing unless otherwise noted. A same reference numeral given in no less than two drawings shall represent a same member or a same portion.

FIG. 1 is a perspective view showing a configuration of a mobile communication terminal 1, i.e., a radio apparatus of the embodiment of the invention. The mobile communication terminal 1 includes a first section 10 and a second section 20 pivotally connected through a hinge section 30. FIG. 1 shows user side faces of the first section 10 and the second section 20 being open to each other while being used.

The first section 10 and the second section 20 may be open or closed to each other, forming but not limited to a flip type structure or a two-axis hinge (double swivel) type structure. The hinge section 30 is a portion arranged between the first section 10 and the second section 20, containing a mechanism configured to allow the first section 10 and the second section 20 to be open or closed to each other, and shown as surrounded by a dashed ellipse in FIG. 1. As illustrated by a dot-and-dash arc with an arrow in FIG. 1, the first section 10 may pivot against the second section 20 on the hinge section 30 so that the first section 10 and the second section 20 may be closed to each other.

The first section 10 has a display unit 11 formed by, e.g., a liquid crystal device on a front face (a face facing a user in FIG. 1) of the first section 10 (another display unit may be provided on another face such as a back face of the first section 10 or of the second section 20). The second section 20 has an operation unit including plural operation keys is provided on a front face of the second section 20 (some of the operation keys may be provided on another face such as a side face of the first section 10 or of the second section 20).

Figure 2:
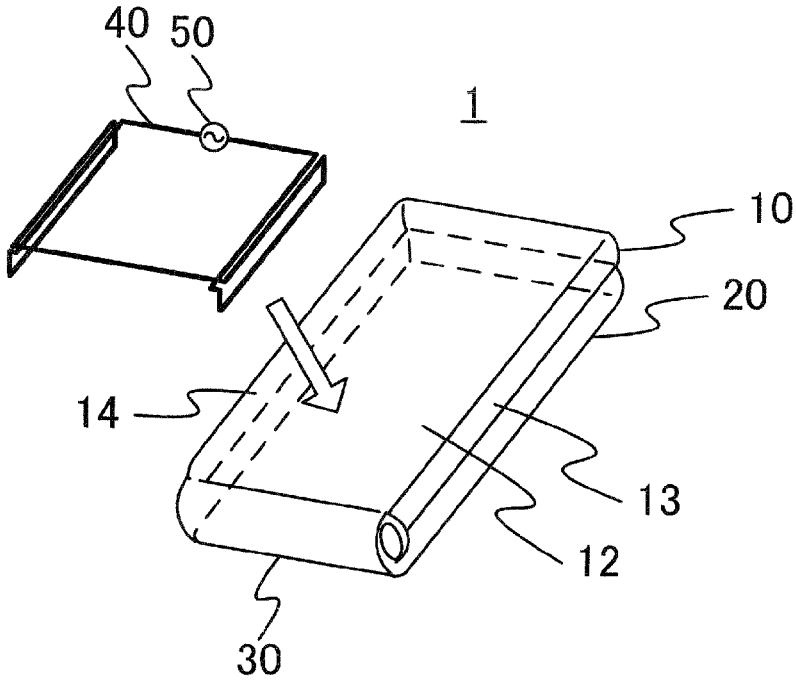
FIG. 2 is a perspective view showing a direction and a position of an antenna provided to the mobile communication terminal of the embodiment in a state that two casings of the mobile communication terminal are closed.

FIG. 2 is a perspective view showing a direction and a position (indicated by a block arrow) of an antenna 40 provided in the first section 10 in a state that the first section 10 of the mobile communication terminal 1 is closed to the second section 20, as viewed from a back side of the first section 10. A back of the front face of the first section 10 is called a back face 12. As viewed in the direction shown in FIG. 2, the mobile communication terminal 1 has a right side face 13 being on a right side of the back face 12, and a left side face 14 being on a left side of the back face 12.

The antenna 40 is an antenna for a card function of a radio frequency identification (RFID) system. The antenna 40 is connected to a feed circuit, that is not shown, at a feed portion 50 indicated by a symbol in FIG. 2 after being provided in the mobile communication terminal 1 so as to form a resonance circuit that may be resonant in a 13 MHz band. The antenna 40 may be formed but, as described later, not limited to by a metal sheet arranged in the first section 10, as intuitively expected from FIG. 2.

Figure 3:
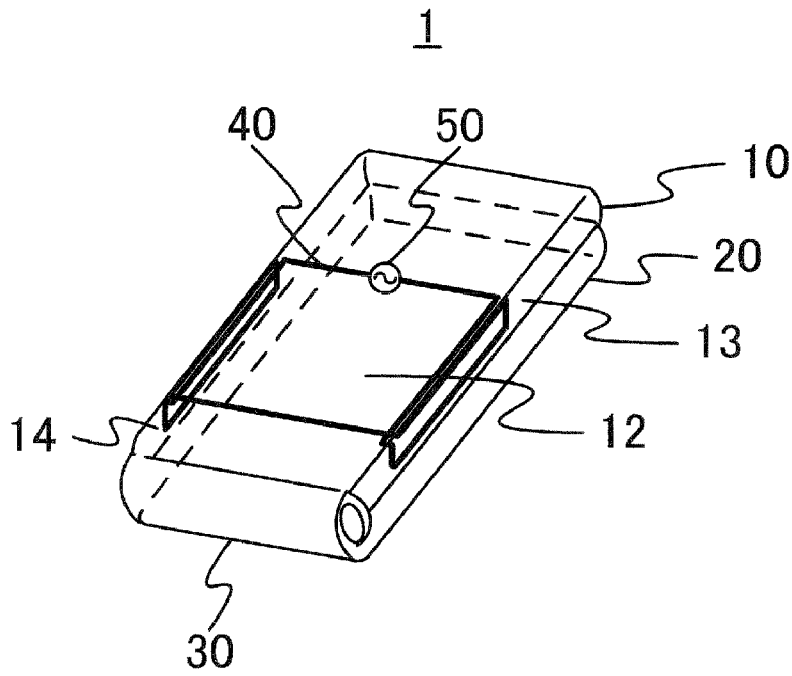
FIG. 3 is a perspective view of the antenna arranged in a first section of the mobile communication terminal of the embodiment of the invention.

FIG. 3 is a perspective view of the antenna 40 arranged in the first section 10 of the mobile communication terminal 1, as viewed in the same direction as shown in FIG. 2. Each of portions shown in FIG. 3 is a same as the corresponding one given the same reference numeral in FIG. 2, and its explanation will be omitted.

Figure 4:
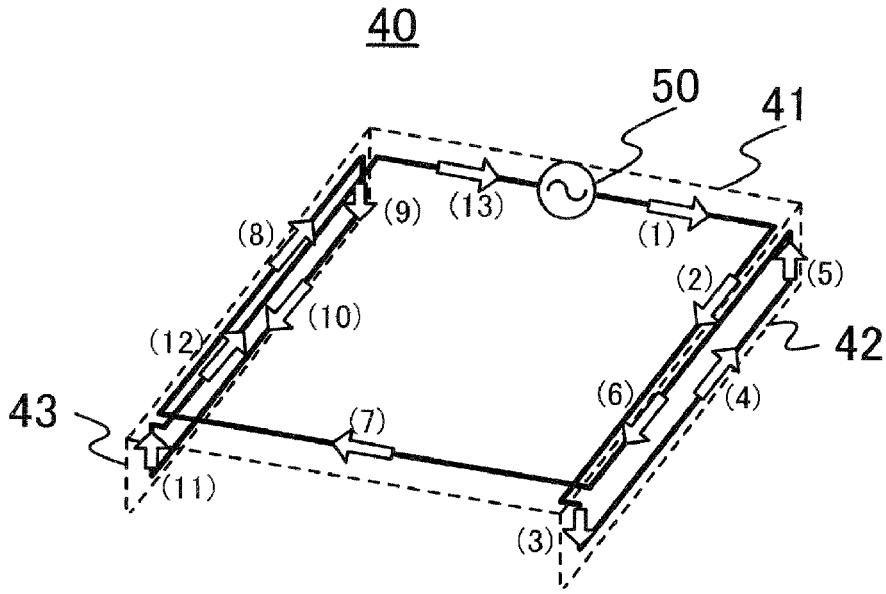
FIG. 4 is a perspective view showing a configuration of the antenna of the embodiment of the invention.

FIG. 4 is a perspective view showing a configuration of the antenna 40, as viewed in the same direction as shown in FIG. 3. The antenna 40 is formed by a conductive line in such a way that a first loop shape 41, a second loop shape 42 and a third loop shape 43 (each of which is shown as surrounded by a dashed frame) are formed by the conductive line. The shape of the conductive line will be described in detail in order of numbers of block arrows starting from the feed portion 50.

The conductive line starting from the feed portion 50 in a right direction, e.g., sequentially passes through a portion indicated by a block arrow (1), turns rightward to pass through a potion indicated by a block arrow (2) and turns downward to pass through a portion indicated by a block arrow (3). The conductive line then sequentially passes through a portion indicated by a block arrow (4) in a direction opposite the portion indicated by the block arrow (6), turns upward to pass through a portion indicated by a block arrow (5) and a portion indicated by a block arrow (6) in the same direction as the portion indicated by the block arrow (2).

The conductive line then turns rightward to pass through a portion indicated by a block arrow (7), turns rightward to pass through a portion indicated by a block arrow (8), and turns downward to pass through a portion indicated by a block arrow (9) in order. The conductive line then passes through a portion indicated by a block arrow (10) that is in a direction opposite the portion indicated by the block arrow (8), turns upward to pass through a portion indicated by a block arrow (11), passes through a portion indicated by a block arrow (12) in the same direction as the portion indicated by the block arrow (8), turns rightward to pass through a portion indicated by a block arrow (13) and reaches the feed portion 50. The conductive line may pass through the above path more than once.

The first loop shape 41 includes the portions indicated by the block arrows, (1), (2), (7), (12) and (13) among the above portions of the conductive line. The second loop shape 42 includes the portions indicated by the block arrows (3), (4), (5) and (6) among the above portions of the conductive line. The third loop shape 43 includes the portions indicated by the block arrows (8), (9), (10) and (11) among the portions of the conductive line.

The first loop shape 41 is almost parallel to the back face 12 of the first section 10. The second loop shape 42 is almost parallel to the right side face 13 of the first section 10. The third loop shape 43 is almost parallel to the left side face 14 of the first section 10. The first to the third loop shapes 41-43 may have plural turns.

The antenna 40 may form a magnetic field distribution mainly in a direction perpendicular to the back face 12 of the first section 10, due to the first loop shape 41. The antenna 40 may form a magnetic field distribution mainly in a direction perpendicular to the right side face 13 of the first section 10, due to the second loop shape 42. The antenna 40 may form a magnetic field distribution mainly in a direction perpendicular to the left side face 14 of the first section 10, due to the third loop shape 43.

The potion indicated by the block arrow (2) of the first loop shape 41 and the portion indicated by the block arrow (6) of the second loop shape 42 are positioned adjacent to each other. As shown by the same direction of the block arrows, currents distributed on the above adjacent portions are spatially almost in a same direction while the antenna 40 is being fed. The portions positioned adjacent to each other may be arranged close to and along an intersection side of the back face 12 and the right side face 13 of the first section 10.

The currents distributed on the portions of the first loop shape 41 and the second loop shape 42 positioned adjacent to each other are spatially almost in the same direction as described above, so as to mutually enhance the magnetic field distribution around the above portions, thus contributing to expansion of space in which the contactless communication is available.

The portion indicated the block arrow (12) of the first loop shape 41 and the portion indicated by the block arrow (8) of the third loop shape 43 are positioned adjacent to each other. As shown by the same direction of the block arrows, currents distributed on the above adjacent portions are spatially almost in a same direction while the antenna 40 id being fed. The portions positioned adjacent to each other may be arranged close to and along an intersection side of the back face 12 and the left side face 14 of the first section 10.

The currents distributed on the portions of the first loop shape 41 and the third loop shape 43 positioned adjacent to each other are spatially almost in the same direction as described above, so as to mutually enhance the magnetic field distributions around the above portions, thus contributing to expansion of the space in which the contactless communication is available.

Having a portion close to the right side face as a right half and a remaining portion close to the left side face 14 as a left half, the first loop shape 41 may be shaped almost left-right symmetric. The second loop shape 42 and the third loop shape 43 may similarly be shaped almost left-right symmetric to each other. The symmetry of the loop shapes may enhance a symmetric feature of the magnetic field distributions in a case where the mobile communication terminal 1 is viewed from the hinge section 30 in a direction parallel to the back face 12 as shown in FIG. 3. Thus, variation of the space in which the contactless communication is available depending on directions may be reduced.

The conductive line of the antenna 40 may be formed by a sheet metal as described above and may be attached to the first section 10. The conductive line of the antenna 40 may be formed by a conductive pattern of a flexible printed board and may be contained in the first section 10 or may be stuck to a surface of material of the first section 10. The conductive line of the antenna 40 may be formed by a conductive pattern plated or stuck to an outer surface (aesthetic surface), an inner surface or both of the material that forms the first section 10.

More specifically, e.g., the material forming the first section 10 may be provided on the outer or inner surface with an adhesive layer made of dielectric material different from the material of the first section 10. The conductive pattern may be plated through the adhesive layer. Due to the adhesive layer, the conductive pattern may be provided regardless of a kind of the dielectric material of the first section 10. Therefore, reinforced dielectric material that is necessary for making the mobile communication terminal 1 thinner may be selected as the material of the first section 10.

If being provided with the conductive pattern of the antenna 40 formed on both of the outer and inner surfaces, the material of the first section 10 needs a via hole so as to electrically connect the outer and inner surfaces. This method for forming the conductive pattern may increase a degree of freedom of a loop shape of the antenna 40.

An example of a characteristic estimation of the embodiment of the present invention will be described with reference to FIGS. 5 and 6. FIG. 7 shows an antenna 45 to be estimated in comparison with the antenna 40. The antenna 45 has portions corresponding to left and right sides of an ordinary loop shaped antenna and bent in the directions of the sides of the casing as shown in FIG. 7 and as viewed in the same direction as in FIG. 4.

Figure 5:
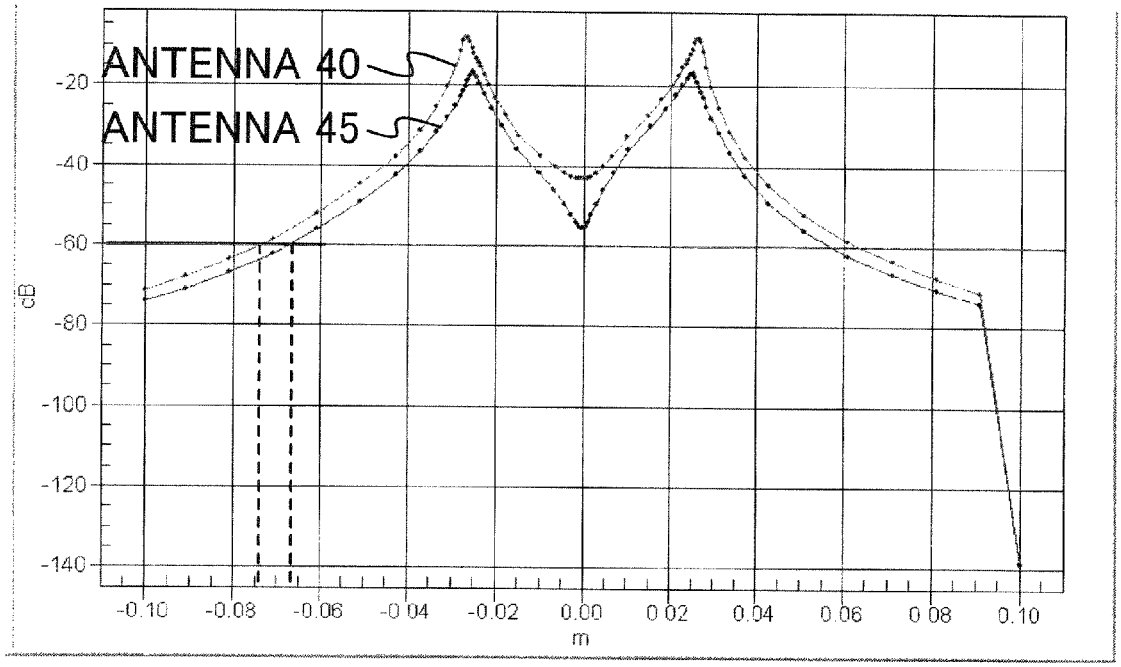
FIG. 5 is a graph illustrating an example of a magnetic field distribution estimated by a simulation in a horizontal (left-to-right) direction while the mobile communication terminal of the embodiment of the invention is viewed from a hinge section in a direction parallel to a back face.

FIG. 5 s a graph illustrating an example of a magnetic field distribution estimated by a simulation in a horizontal (left-to-right) direction (the left side 14 and the right side 13 correspond to left and right, respectively), while the mobile communication terminal 1 is viewed from the hinge section 30 in a direction parallel to the back face 12 shown in FIG. 3 and the antenna 40 is being fed. The graph has a horizontal axis representing a length measured leftward and rightward from a central portion of the mobile communication terminal 1 in the horizontal direction. The graph has a vertical axis representing strength of the magnetic field distribution. A characteristic of a configuration that the antenna 40 is replaced by the antenna 45 has been estimated for comparison by a similar simulation.

It is assumed that a threshold of the magnetic field distribution strength that determines success or failure in the communication ill the above horizontal direction is, e.g., −60 dB. As shown in FIG. 5, the antenna 40 and the antenna 45 show lengths of 75 millimeters (mm) and 66 mm in the leftward direction in association with the above threshold, respectively. That means the antenna 40 gains improvement of 9 mm in comparison with the antenna 45. In addition, in an almost entire range in the horizontal direction included in FIG. 5, the magnetic field strength generated by the antenna 40 is higher than the magnetic field strength generated by the antenna 45, which may prove an effect of the embodiment.

Figure 6:
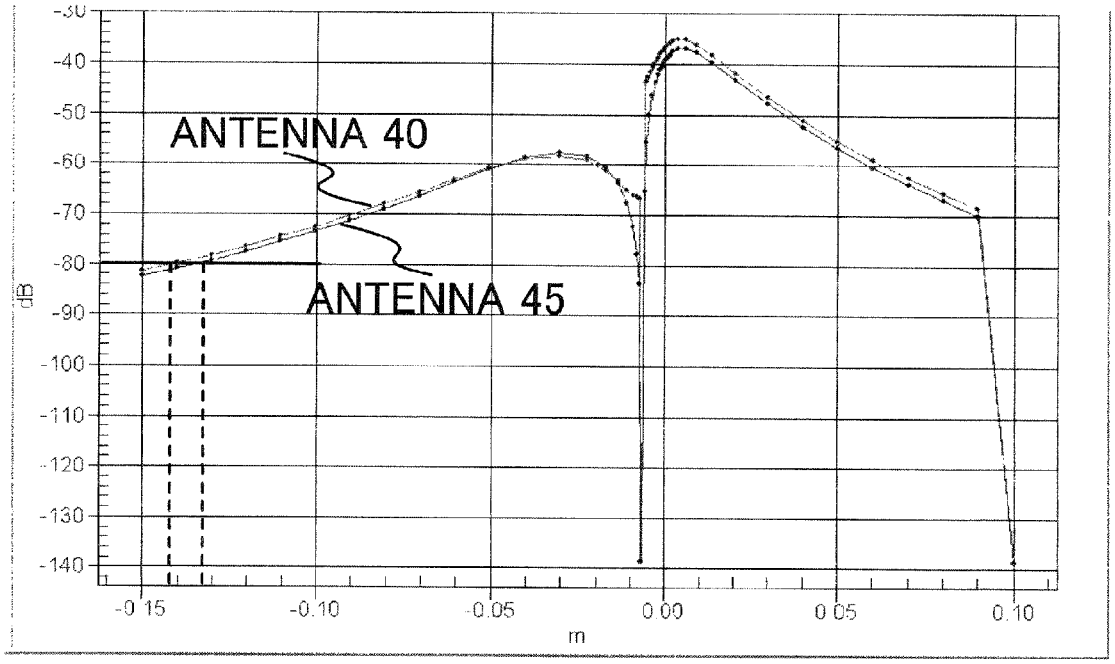
FIG. 6 is a graph illustrating an example of a magnetic field distribution estimated by a simulation in a vertical direction while the mobile communication terminal of the embodiment of the invention is viewed from the hinge section in the direction parallel to the back face.
Figure 7:
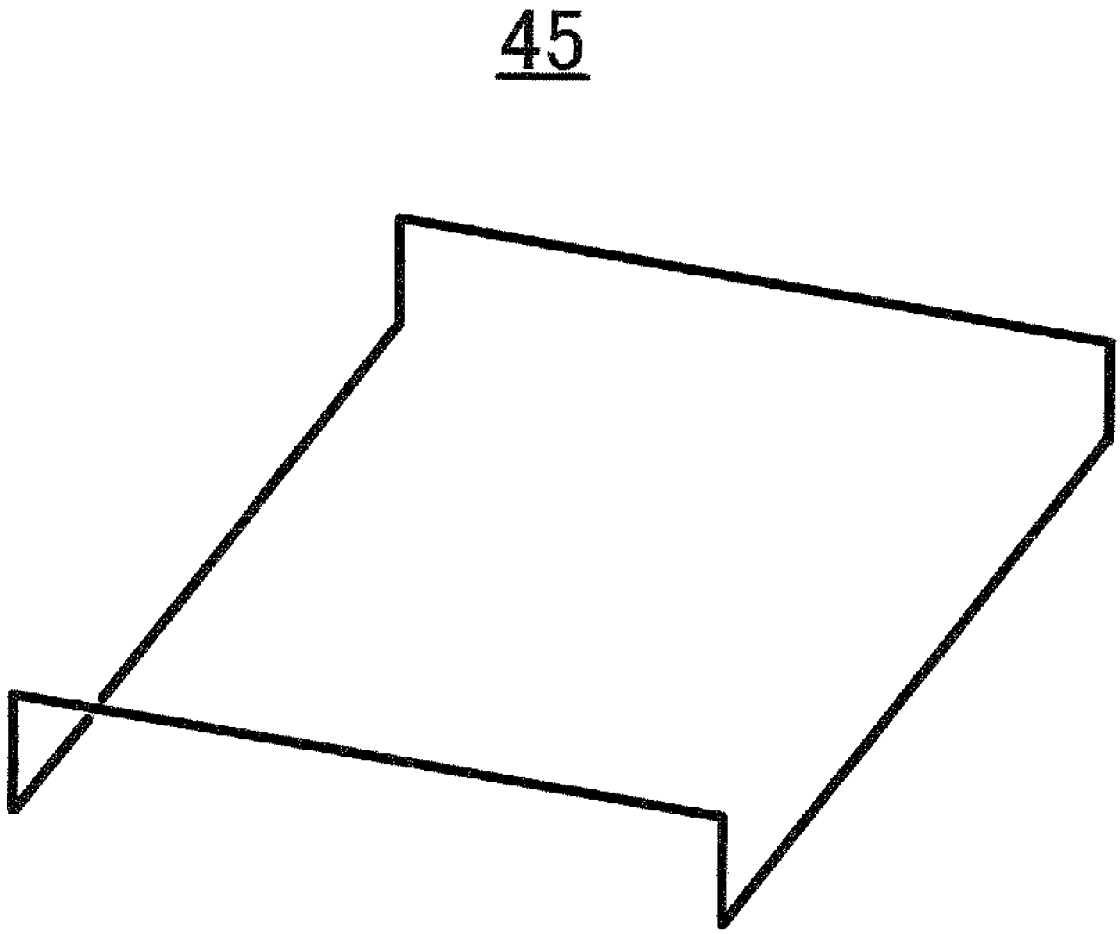
FIG. 7 is a perspective view of a configuration having portions corresponding to left and right sides of an ordinary loop-shaped antenna, and bent in the directions of the sides of the casing.

FIG. 6 is a graph illustrating an example of a magnetic field distribution estimated by a simulation in a vertical direction (a direction normal to the back face 12) while the mobile communication terminal 1 is viewed from the hinge section 30 in the direction parallel to the back face 12 shown in FIG. 3 and the antenna 40 is being fed. The graph has a horizontal axis representing a length measured upward and downward from the central position of the mobile communication terminal 1. The graph has a vertical axis representing strength of the magnetic field distribution. A characteristic of the configuration that the antenna 40 is replaced by the antenna 45 has been estimated for comparison by a similar simulation.

It is assumed that a threshold of the magnetic field distribution strength that determines success or failure in the communication in the above vertical direction is, e.g., −80 dB. As shown in FIG. 6, the antenna 40 and the antenna 45 show lengths of 132 mm and 142 mm in the downward direction (the direction opposite the back face 12) in association with the above threshold, respectively. That means the antenna 40 gains improvement of 10 mm in comparison with the antenna 45. In addition, in an almost entire range in the vertical direction included in FIG. 6, the magnetic field strength generated by the antenna 40 is higher than the magnetic field strength generated by the antenna 45, which may prove an effect of the embodiment.

According to the embodiment of the invention described above, the antenna configured that the loop shapes are directed in plural directions of the casing and the currents distributed on the adjacent portions of the loop shapes are directed in the same direction may expand space in which the contactless communication is available.

In the above description of the embodiment, the shapes of the loops and other portions of the antenna, the number of turns of the loop, the layout, the relative position, the route and the order of the portions of the conductive line of the antenna, and conditions defined in the simulations are exemplary only, and may be variously modified within the scope of the invention.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments where chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

(Drawings)
FIG. 1
CLOSE 1ST & 2ND SECTIONS
FIG. 5
ANTENNA 40
ANTENNA 45
FIG. 6
ANTENNA 40
ANTENNA 45

What is claimed is:

1. A radio apparatus comprising:

a casing having a first face, a second face corresponding to a side face of the first face, and a third face corresponding to another side face of the first face; and an antenna formed by a conductive line in such a way that the conductive line forms a first loop shape, a second loop shape and a third loop shape, that the first loop shape includes a first portion and a second portion positioned adjacent to a third portion of the second loop shape and a fourth portion of the third loop shape, respectively, that directions of currents distributed on the first portion and the third portion if the antenna is fed are almost same, and that directions of currents distributed on the second portion and the fourth portion if the antenna is fed are almost same.

2. The radio apparatus of claim 1, wherein the first portion and the third portion are arranged close to and along an intersection side of the first loop shape and the second loop shape.

3. The radio apparatus of claim 1, wherein the second portion and the fourth portion are arranged close to and along an intersection side of the first loop shape and the third loop shape.

4. The radio apparatus of claim 1, wherein if the casing is viewed from such a direction that the second face and the third face correspond to a left side face and a right side face of the casing, respectively, the first loop shape is shaped left-right symmetric, and that the second loop shape and the third loop shape are shaped left-right symmetric to each other.

5. The radio apparatus of claim 1, wherein at least a portion of the conductive line is formed on a surface of a material forming the casing.

6. The radio apparatus of claim 1, wherein at least a portion of the conductive line is formed on an outer surface and an inner surface of a material forming the casing.

7. An antenna formed by a conductive line provided in an apparatus casing having a first face, a second face corresponding to a side face of the first face, and a third face corresponding to another side face of the first face, comprising:

a first loop-shaped portion arranged almost parallel to the first face, the first loop-shaped portion including a first portion and a second portion;

a second loop-shaped portion arranged almost parallel to the second face, the second loop-shaped portion including a third portion arranged adjacent to the first portion, the second loop-shaped portion arranged in such a way that directions of currents distributed on the first portion and the third portion if the antenna is fed are almost same; and a third loop-shaped portion arranged almost parallel to the third face, the third loop-shaped portion including a fourth portion arranged adjacent to the second portion, the third loop-shaped portion arranged in such a way that directions of currents distributed on the second portion and the fourth portion if the antenna is fed are almost same.

8. The antenna of claim 7, wherein the second portion and the fourth portion are arranged close to and along an intersection side of the first loop shape and the third loop shape.

9. The antenna of claim 7, wherein the second portion and the fourth portion are arranged close to and along an intersection side of the first loop shape and the third loop shape.

10. The antenna of claim 7, wherein if the casing is viewed from such a direction that the second face and the third face correspond to a left side face and a right side face of the casing, respectively, the first loop-shaped portion is shaped left-right symmetric, and that the second loop-shaped portion and the third loop-shaped portion are shaped left-right symmetric to each other.

11. The antenna of claim 7, wherein at least a portion of the conductive line is formed on a surface of a material forming the casing.

12. The antenna of claim 7, wherein at least a portion of the conductive line is formed on an outer surface and an inner surface of a material forming the casing.

* * * * *